United States Patent [19]

Allen et al.

[11] 4,119,038

[45] Oct. 10, 1978

[54] CONTROLLED ACTIVATION OF RESERVE POWER SUPPLIES

[75] Inventors: Floyd Allen, Washington, D.C.; Asaf A. Benderly, Potomac, Md.

[73] Assignee: The United States of America as represented by the Secretary of the Army, Washington, D.C.

[21] Appl. No.: 796,583

[22] Filed: May 13, 1977

[51] Int. Cl.[2] ..... F42C 11/06

[52] U.S. Cl. ..... 102/207

[58] Field of Search ..... 102/70.2 R; 320/31

[56] References Cited

U.S. PATENT DOCUMENTS

| | | | |
|---|---|---|---|
| 2,403,567 | 7/1946 | Wales, Jr. | 102/70.2 R |
| 2,906,206 | 9/1959 | Morison et al. | 102/70.2 R |
| 2,931,848 | 4/1960 | Burrell | 102/70.2 R |
| 3,088,409 | 5/1963 | Yavelberg | 102/70.2 R |
| 3,548,749 | 12/1970 | Dreitzler | 102/70.2 R |

*Primary Examiner*—Charles T. Jordan

*Attorney, Agent, or Firm*—Nathan Edelberg; Robert P. Gibson; Saul Elbaum

[57] ABSTRACT

A time-delay RC circuit, having a preselected time constant, is connected across a reserve battery undergoing activation. The function of the circuit is to hold off the application of the load of a power utilization device until the battery is sufficiently activated. Since the drain rate of the time-delay circuit is very small, it does not retard activation via polarization as would be the case if the full load were draining the battery during activation. A first switching transistor is connected across the charging capacitor of the RC circuit and turns on when the time constant is reached. When the first switching transistor is turned on, it turns on a second switching transistor connected between the battery and the utilization device.

10 Claims, 1 Drawing Figure

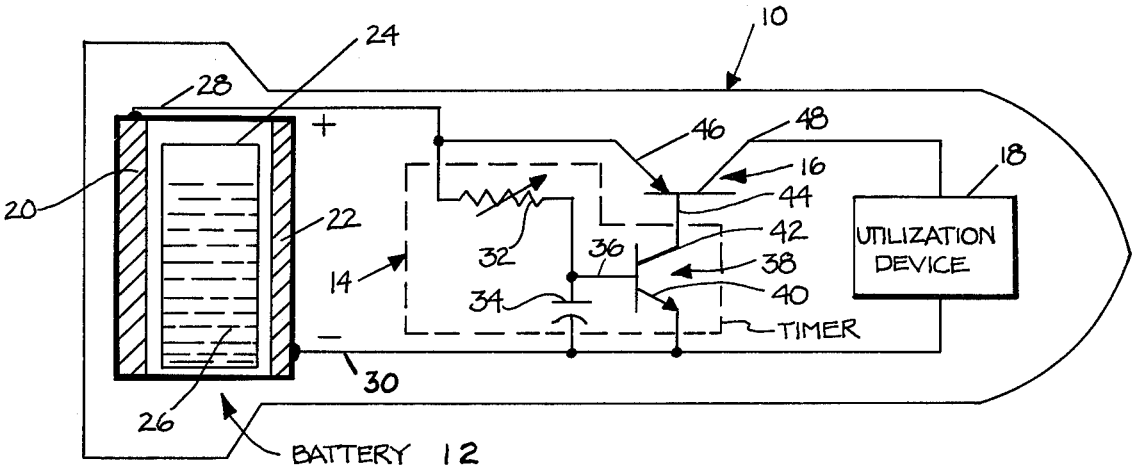
10
24
28
+
46
48
16
18
20
22
44
42
UTILIZATION DEVICE
32
36
38
14
34
40
TIMER
30
26
BATTERY 12

CONTROLLED ACTIVATION OF RESERVE POWER SUPPLIES

RIGHTS OF THE GOVERNMENT

The invention described herein may be manufactured, used, and licensed by or for the United States Government for governmental purposes without the payment to us of any royalty thereon.

FIELD OF THE INVENTION

The present invention relates to timing circuits and more particularly to a timing circuit that permits full activation of a reserve battery before a load is placed across it.

BRIEF DESCRIPTION OF THE PRIOR ART

In ordnance devices a reserve battery is often provided to power an electronic time fuze. A special purpose battery is often used in ordnance devices so that the battery may reach full power upon deployment after a long period of unactivated storage. One such battery includes an electrolyte contained in a frangible ampule. The ampule is broken upon impact of the ordnance device or caused to break by a condition responsive mechanism. The primary difficulty in utilizing such types of reserve batteries, pre-connected across a load, is that the batteries must activate at high current density due to the immediate electrical drain, thereby resulting in the undesirable condition of polarization, or voltage depression.

Battery activation time of the order of 50 msec. is critical in "electronic time fuze" applications because it determines the accuracy of the fuze timing. Wide variations in activation time often occur in batteries discharged at −40° F following storage at +160° F for periods of 60 to 120 days. When a battery has been stored hot and in subsequent tests at low temperature is filled with electrolyte under load, it often polarizes, producing the effect of a high internal resistance for some unpredictable interval.

Polarization can be explained thusly. Battery cells do not fill with electrolyte instantaneously, particularly at low spin (47 rps) and low temperature. Drawing heavy currents from a partially wetted cell area results in extremely high current densities. This causes the small wetted area to become polarized because reaction products cannot be carried away fast enough to cleanse the cell surface. This same condition continues incrementally as the cell area gradually fills. Therefore, the cell will take a long time to depolarize, if it depolarizes at all, i.e., the voltage will not rise to its normal level. Polarization effects can be greatly reduced by keeping the initial current draw very small and applying the main load only after the cell is essentially filled with electrolyte.

BRIEF DESCRIPTION OF THE PRESENT INVENTION

The present invention is directed to the utilization of a relatively simple switching circuit in combination with a reserve battery for providing a reliable power source for a utilization device or load such as an electronic time fuze for an ordnance device. By using the timing device, a fixed time must pass during which the electrolyte from an opened ampule fills the cells of the battery to a full activation condition. During the time that the electrolyte fills the battery, a very small current is drawn for operating the timing circuitry. At the time of full activation, the timing circuit switches the battery across the load for normal operation. Although heavy currents will be drawn when the utilization device loads the battery, the battery will be in a fully activated condition, permitting the heavy delivery of current to the utilization device without the problem of polarization.

BRIEF DESCRIPTION OF THE FIGURE

The above-mentioned objects and advantages of the present invention will be more clearly understood when considered in conjunction with the accompanying drawing, in which:

The FIGURE is an electrical schematic diagram of the present invention as utilized in conjunction with a reserve battery, of the type described.

DETAILED DESCRIPTION OF THE INVENTION

Referring to the FIGURE, the pictoral outline representation of an ordnance device such as a missile, bomb or the like, is shown at 10. A reserve battery or the type mentioned is disposed within the ordnance device 10 and is connected to timing circuitry to be described in greater detail hereinafter. The timing circuitry is interposed between the reserve battery 12 and a utilization device 18, which may be an electronic time fuze so that the reserve battery may achieve full activation before delivering heavy currents. Otherwise, high current densities will occur at the electrodes of the battery 12 thereby causing the battery to become polarized and develop high internal resistance in the battery which greatly affects the reliability and operation of the utilization device 18. The mentioned timing circuitry includes two basic sections. The first section is a timer 14 which turns on a switching transistor 16 connected between the battery 12 and the utilization device 18. In operation of the invention, after a preselected time constant passes, as determined by the timer 14, the battery 12 has the opportunity of becoming completely filled with electrolyte so that full activation is possible. Shortly after full activation, the switching transistor 16 connects the battery 12 across the utilization device so that full power may be delivered without polarizing the battery 12.

The reserve battery 12 has the simplified structure illustrated in the FIGURE. Electrodes 20 and 22 are positioned in spaced relationship to each other and are separated by a frangible ampule 24 that contains an appropriate electrolyte 26. Normally, the electrolyte is contained by the ampule so that the battery is in a deactivated condition. However, upon impact or in response to a condition sensitive mechanism (not shown), which is not, per se, part of the invention, the ampule 24 is broken and the electrolyte 26 fills the space between the electrodes 20 and 22. It is at this time that it is exceedingly important that no substantial current be drawn from the battery or the previously discussed polarization problem will result. A first lead 28 is connected to the first electrode 20 to carry the positive potential for the battery. In a similar manner, a second lead 30 is connected to the second electrode 22 of the battery to carry the negative potential of the battery. Both of the leads 28 and 30 are introduced to the timer 14.

A resistor 32 has a first terminal thereof connected to the lead 28 while the second terminal of the resistor 32 is connected to the first terminal of a charging capacitor 34. The opposite terminal of the capacitor is connected to the lead 30. The resistor 32 and capacitor 34 form the RC components for a time constant circuit. The base 36 of transistor 38 is connected to the upper terminal of the charging capacitor 34 so that after a particular time constant when the capacitor 34 is fully charged, the transistor 38 will be turned on and current will flow from the resistor 32 to the base 36 and through the emitter 40 of transistor 38 to the negative return lead 30. As the collector 42 of transistor 38 changes its potential when the transistor is turned on, the base 44 of a second switching transistor 16 has its potential changed so that the second switching transistor 16 is also turned on. Thus, the timer 14 serves as a timing circuit for turning on the second transistor 16 which functions as a relay device. Once the transistor 16 is turned on, a current path is created between battery 12, positive lead 28, emitter 46 connected to this lead, collector 48 and the positive terminal of utilization device 18 which is connected to the collector 48. The opposite terminal of the utilization device returns to the negative lead 30 to complete a current loop. The second switching transistor 16 is not turned on until the time constant of the timer 14 is achieved. The resistor 32 may be a temperature-compensated resistor so that provision can optionally be made to correct the circuitry for temperature induced variables, as desired. In a preferred embodiment of the present invention, the resistor 32 will be a resistor having a positive temperature coefficient.

It should be understood that the invention is not limited to the exact details of construction shown and described herein for obvious modifications will occur to persons skilled in the art.

We claim the following:

1. A system for controlling the activation of a reserve battery comprising:

a reserve battery activated in response to a predetermined external condition;

a utilization device powered by the battery;

timing means connected to the battery for switching on after a preselected time constant elapses subsequent to the instant of initial battery activation, said timing means operated by the reserve battery; and switching means connected between the battery and the utilization device for switching current from said reserve battery to said utilization device responsive to the timing means, said timing means operating said switching means upon lapsing of said preselected time constant, so that the utilization device draws load current from the battery only after full activation of the battery thereby preventing polarization of the battery.

2. The subject matter set forth in claim 1 wherein the battery includes electrolyte contained in a package which releases the electrolyte for battery activation in response to a predetermined external condition.

3. The subject matter set forth in claim 1 wherein the timing means comprises:

an RC circuit having a capacitor component which charges in response to battery activation; and a first transistor switch connected to the capacitor for switching on in response to a preselected charging voltage developed across the capacitor.

4. The subject matter set forth in claim 1 wherein the switching means is a switching transistor having its base electrode connected to an output terminal of the timing means and further having its remaining electrodes connected between the battery and the utilization device.

5. The subject matter set forth in claim 1 wherein the utilization device is an electronic fuze for an ordnance device.

6. The subject matter set forth in claim 3 wherein the RC circuit further includes a resistor of preselected temperature coefficient for achieving a desired temperature compensation.

7. The subject matter set forth in claim 6 wherein the switching means is a second switching transistor having its base electrode connected to an output terminal of the timing means and further having its remaining electrodes connected between the battery and the utilization device.

8. The subject matter set forth in claim 7 wherein the utilization device is an electronic fuze for an ordnance device.

9. The subject matter set forth in claim 8 wherein said battery includes electrolyte stored in a package comprising a frangible ampule.

10. The subject matter set forth in claim 9 wherein battery electrodes are normally positioned in spaced relationship with the ampule located therebetween.

* * * * *